US009127873B2

(12) United States Patent
Tarr et al.

(10) Patent No.: US 9,127,873 B2
(45) Date of Patent: Sep. 8, 2015

(54) TEMPERATURE CONTROLLED COMPARTMENT AND METHOD FOR A REFRIGERATOR

(75) Inventors: Ronald Scott Tarr, Louisville, KY (US); Matthew William Davis, Prospect, KY (US); Alvaro Delgado, Louisville, KY (US); Omar Haidar, Louisville, KY (US); Alexander Pinkus Rafalovich, Louisville, KY (US); Toby Whitaker, Loveland, CO (US); Martin Mitchell Zentner, Prospect, KY (US)

(73) Assignee: General Electric Company, Schenectady, NY (US)

( * ) Notice: Subject to any disclaimer, the term of this patent is extended or adjusted under 35 U.S.C. 154(b) by 1393 days.

(21) Appl. No.: 11/958,900

(22) Filed: Dec. 18, 2007

(65) Prior Publication Data

US 2009/0151375 A1 Jun. 18, 2009
US 2012/0031129 A9 Feb. 9, 2012

Related U.S. Application Data

(63) Continuation-in-part of application No. 11/610,798, filed on Dec. 14, 2006, now Pat. No. 7,610,773.

(51) Int. Cl.
*F25D 17/02* (2006.01)
*F25D 11/02* (2006.01)
*F25B 25/00* (2006.01)

(52) U.S. Cl.
CPC ..... *F25D 11/025* (2013.01); *F25B 25/005* (2013.01); *F25C 2400/10* (2013.01)

(58) Field of Classification Search
CPC ..... F25D 11/025; F25B 25/005
USPC ..... 62/201, 430, 180, 340–356, 434–435, 62/377, 441; 165/110, 80.4, 104.33
See application file for complete search history.

(56) References Cited

U.S. PATENT DOCUMENTS

| | | | | |
|---|---|---|---|---|
| 1,962,580 A | | 6/1934 | Carpenter | |
| 1,992,018 A | | 2/1935 | Steenstrup | |
| 2,120,185 A | * | 6/1938 | Philipp | 62/199 |
| 2,128,794 A | * | 8/1938 | Billings | 62/201 |
| 2,287,225 A | | 6/1942 | Beanblossom | |
| 2,287,255 A | * | 6/1942 | Langgaard | 62/346 |
| 2,503,922 A | | 4/1950 | Schmacher | |
| 2,514,301 A | | 7/1950 | Tenney | |
| 2,942,432 A | | 6/1960 | Muffly | |
| 3,218,111 A | * | 11/1965 | Steiner | 312/405.1 |
| 3,659,429 A | * | 5/1972 | McLean | 62/157 |
| 3,788,089 A | * | 1/1974 | Graves | 62/137 |

(Continued)

OTHER PUBLICATIONS

U.S. Appl. No. 11/610,798, filed Dec. 14, 2006, Alexander Pinkus Rafalovich, et al.

(Continued)

*Primary Examiner* — Jonathan Bradford
(74) *Attorney, Agent, or Firm* — Dority & Manning, P.A.

(57) ABSTRACT

A secondary loop temperature control circuit for a temperature-controlled region in a compartment of a refrigerator is shown. The secondary loop temperature control circuit has a reservoir, configured to have a medium flow there through. A first heat exchanger is in flow communication with the reservoir and is configured to have the medium flow there through. The first heat exchanger is in thermal communication with the temperature-controlled region.

20 Claims, 8 Drawing Sheets

(56) References Cited

U.S. PATENT DOCUMENTS

| | | | | | |
|---|---|---|---|---|---|
| 4,280,335 | A | | 7/1981 | Perez et al. | |
| 4,344,298 | A | | 8/1982 | Biemiller | |
| 4,368,622 | A | * | 1/1983 | Brooks | 62/157 |
| 4,444,223 | A | | 4/1984 | Maldavs | |
| 4,543,800 | A | * | 10/1985 | Mawby et al. | 62/339 |
| 4,907,417 | A | * | 3/1990 | Forsythe | 62/199 |
| 4,942,742 | A | | 7/1990 | Burruel | |
| 4,984,435 | A | | 1/1991 | Seino et al. | |
| 5,005,379 | A | | 4/1991 | Brown | |
| 5,055,379 | A | | 10/1991 | Bagchi et al. | |
| 5,211,462 | A | * | 5/1993 | Bien et al. | 312/404 |
| 5,307,642 | A | * | 5/1994 | Dean | 62/59 |
| 5,327,736 | A | | 7/1994 | Hino | |
| 5,406,805 | A | * | 4/1995 | Radermacher et al. | 62/81 |
| 5,743,109 | A | | 4/1998 | Shulak | |
| 5,755,104 | A | | 5/1998 | Rafalovich et al. | |
| 5,946,934 | A | * | 9/1999 | Kim et al. | 62/408 |
| 5,964,101 | A | | 10/1999 | Shulak et al. | |
| 6,018,961 | A | * | 2/2000 | Venture et al. | 62/434 |
| 6,148,634 | A | * | 11/2000 | Sherwood | 62/434 |
| 6,205,795 | B1 | | 3/2001 | Backman et al. | |
| 6,216,469 | B1 | | 4/2001 | Miller | |
| 6,253,563 | B1 | | 7/2001 | Ewert et al. | |
| 6,293,107 | B1 | | 9/2001 | Kitagawa et al. | |
| 6,467,279 | B1 | | 10/2002 | Backman et al. | |
| 6,474,093 | B1 | * | 11/2002 | Fink et al. | 62/434 |
| 6,588,219 | B2 | | 7/2003 | Zevlakis | |
| 6,655,170 | B2 | | 12/2003 | Holz et al. | |
| 6,973,799 | B2 | * | 12/2005 | Kuehl et al. | 62/244 |
| 7,051,543 | B2 | | 5/2006 | Trujillo, Jr. et al. | |
| 7,181,921 | B2 | | 2/2007 | Nuiding | |
| 7,190,583 | B1 | * | 3/2007 | Fendley et al. | 361/701 |
| 7,216,494 | B2 | | 5/2007 | Thurman | |
| 7,216,499 | B2 | | 5/2007 | Flinner et al. | |
| 7,322,204 | B2 | * | 1/2008 | Hirao et al. | 62/255 |
| 7,610,773 | B2 | * | 11/2009 | Rafalovich et al. | 62/356 |
| 8,001,795 | B2 | * | 8/2011 | Pfister et al. | 62/62 |
| 2002/0088242 | A1 | | 7/2002 | Williams | |
| 2004/0031280 | A1 | * | 2/2004 | Martin et al. | 62/246 |
| 2004/0237565 | A1 | | 12/2004 | Lee et al. | |
| 2004/0244396 | A1 | | 12/2004 | Lane et al. | |
| 2005/0223730 | A1 | * | 10/2005 | Kester et al. | 62/259.2 |
| 2006/0037329 | A1 | | 2/2006 | Narayanamurthy | |
| 2006/0144053 | A1 | | 7/2006 | Zhang et al. | |
| 2007/0101761 | A1 | | 5/2007 | Yanik et al. | |
| 2007/0137241 | A1 | | 6/2007 | Lee et al. | |
| 2008/0141699 | A1 | | 6/2008 | Rafalovich et al. | |
| 2008/0148761 | A1 | | 6/2008 | Venkatakrishnan et al. | |
| 2008/0156009 | A1 | | 7/2008 | Cur et al. | |
| 2008/0156022 | A1 | | 7/2008 | LeClear et al. | |
| 2009/0151375 | A1 | * | 6/2009 | Tarr et al. | 62/180 |

OTHER PUBLICATIONS

U.S. Appl. No. 12/508,253, filed Jul. 23, 2009, Alexander Pinkus Rafalovich, et al.

U.S. Appl. No. 11/960,956, filed Dec. 20, 2007, Alexander Pinkus Rafalovich, et al.

U.S. Appl. No. 11/167,681, filed Jun. 27, 2005, Angelika Utecht.

Final Rejection towards corresponding U.S. Appl. No. 11/960,956 dated Feb. 14, 2013.

Non-Final Rejection towards corresponding U.S. Appl. No. 11/960,956 dated Oct. 3, 2013.

* cited by examiner

TEMPERATURE CONTROLLED COMPARTMENT AND METHOD FOR A REFRIGERATOR

CROSS-REFERENCE TO RELATED APPLICATIONS

This application is a continuation-in-part application of and claims priority to and the benefit of U.S. patent application Ser. No. 11/610,798, filed on Dec. 14, 2006, now U.S. Pat. No. 7,610,773.

BACKGROUND OF THE INVENTION

This invention relates generally to refrigerators, and more particularly, to a temperature controlled compartment in refrigerators.

In a known refrigerator, an icemaker delivers ice through an opening in the door of a refrigerator. Such a known refrigerator has a freezer section to the side of a fresh food section. This type of refrigerator is often referred to as a "side-by-side" refrigerator. In the side-by-side refrigerator, the icemaker delivers ice through the door of the freezer section. In this arrangement, ice is formed by freezing water with cold air in the freezer section, the air being made cold by a cooling system including an evaporator.

Another known refrigerator includes a bottom freezer section disposed below a top fresh food section. This type of refrigerator is often referred to as a "bottom freezer" or a "bottom mount freezer" refrigerator. In this arrangement, convenience necessitates that the icemaker deliver ice through the opening in the door of the fresh food section, rather than through the freezer section. However, the cool air in the fresh food section is generally not cold enough to freeze water to form ice.

In the bottom freezer refrigerator, it is known to pump cold air, which is cooled by the evaporator of the cooling system, within an interior of the door of the fresh food section to the icemaker. This arrangement suffers from numerous disadvantages. For example, complicated air ducts are required within the interior of the door for the cold air to flow to the icemaker. Further, ice is made at a relatively slow rate due to volume and/or temperature limitations of cold air that can be pumped within the interior of the door of the fresh food section. Another disadvantage is that pumping the cold air from the fresh food compartment during ice production reduces the temperature of the fresh food compartment below the set point.

BRIEF DESCRIPTION OF THE INVENTION

In one aspect of the invention, a secondary loop temperature control circuit for a temperature-controlled region in a compartment of a refrigerator is shown. The secondary loop temperature control circuit has a reservoir, configured to have a medium flow there through. A first heat exchanger is in flow communication with the reservoir and is configured to have the medium flow there through. The first heat exchanger is in thermal communication with the temperature-controlled region.

In yet another aspect of the invention, a refrigerator comprises a secondary loop temperature control circuit. The secondary loop temperature control circuit comprises a reservoir in a first compartment of the refrigerator. The reservoir is configured to have a medium flow there through and is in thermal communication with a first heat exchanger. A second heat exchanger is in flow communication with the reservoir and is configured to have the medium flow there through. The second heat exchanger is in thermal communication with the temperature-controlled region in a second compartment of the refrigerator.

DETAILED DESCRIPTION OF THE INVENTION

It is contemplated that the teaching of the description set forth below is applicable to all types of refrigeration appliances, including but not limited to side-by-side and top mount refrigerators wherein undesirable temperature gradients exist within the compartments. The present invention is therefore not intended to be limited to any particular type or configuration of a refrigerator, such as refrigerator 100.

Figure 1:
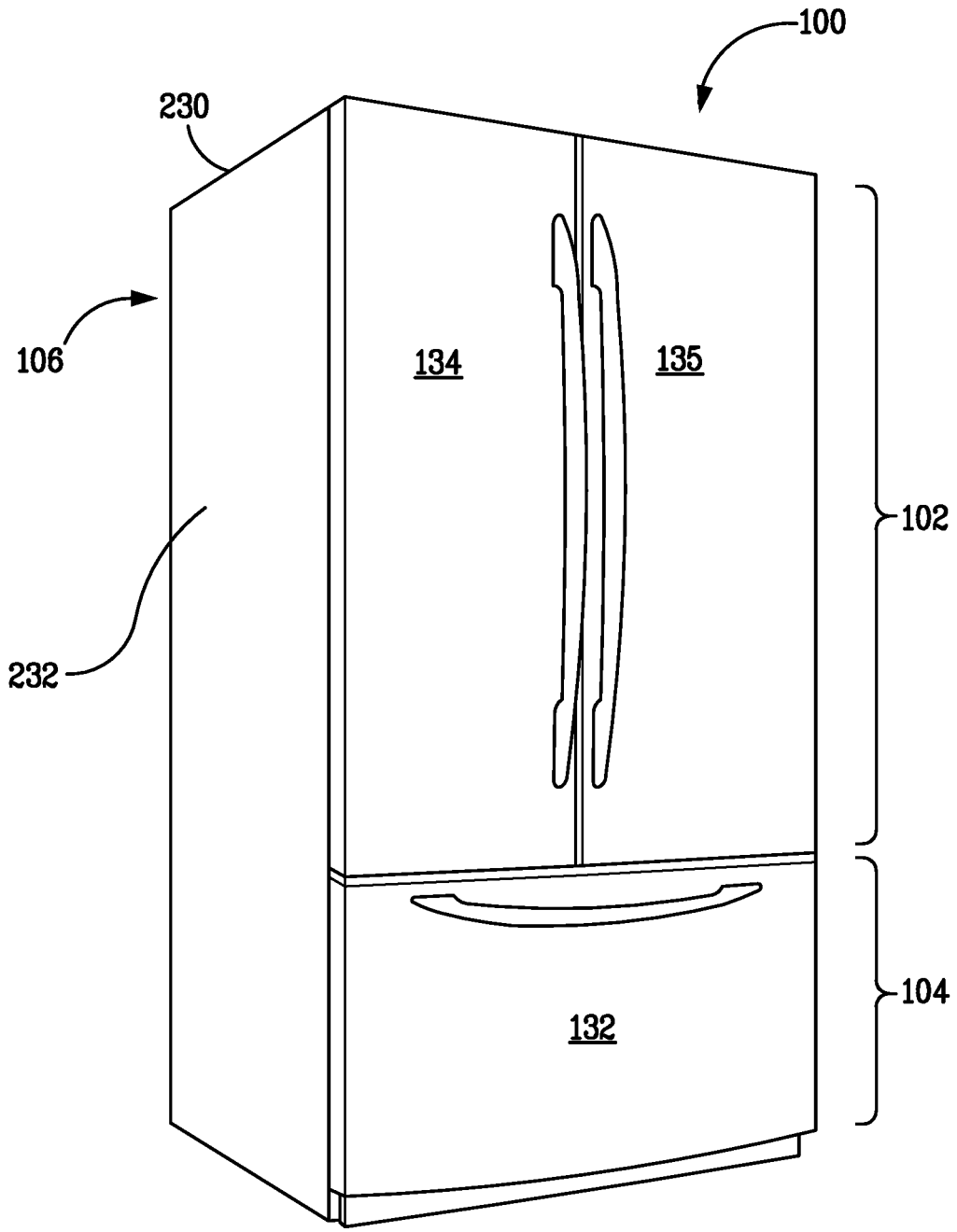
FIG. 1 is a perspective view of a refrigerator.
Figure 2:
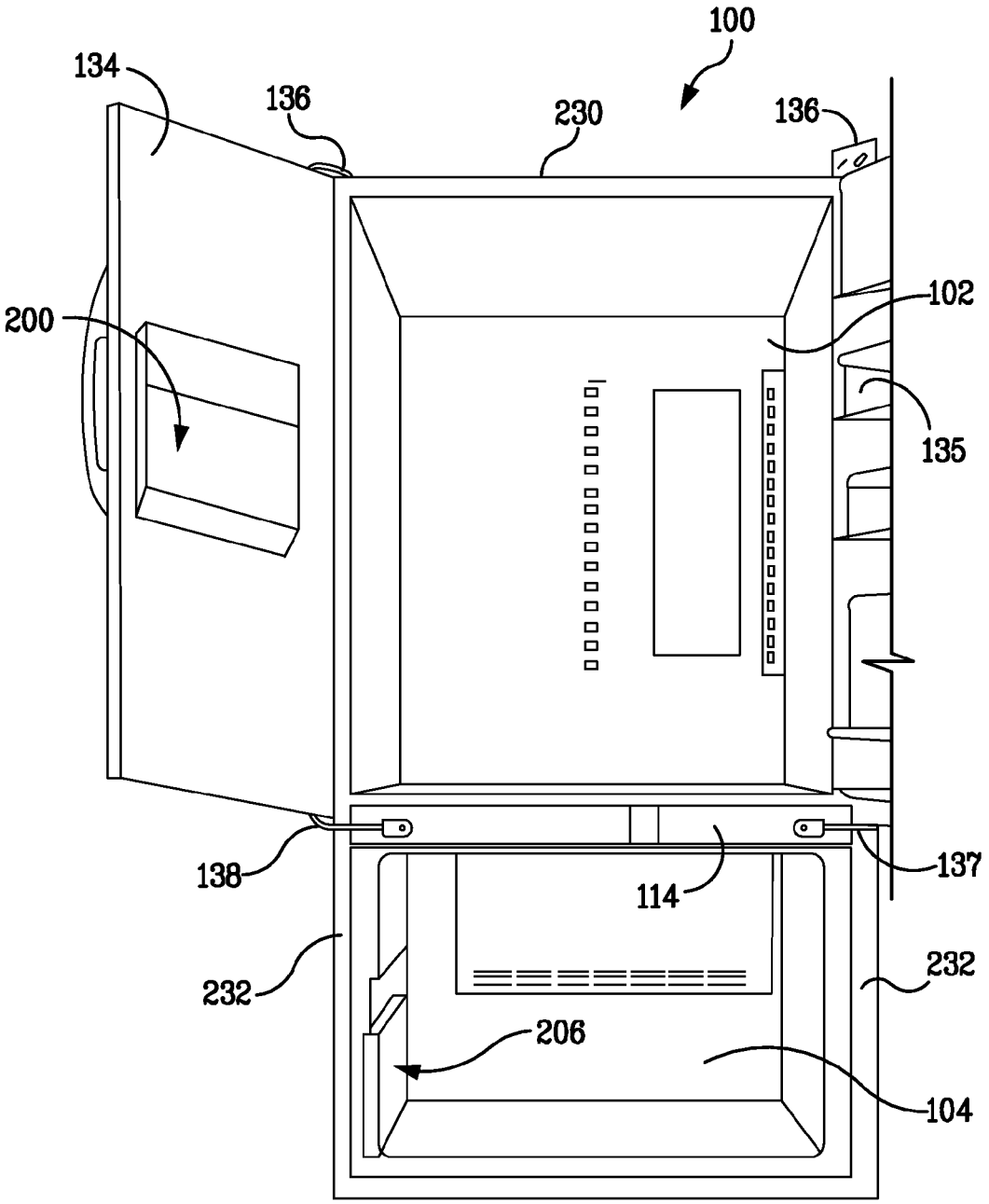
FIG. 2 is a perspective view of a refrigerator of FIG. 1 with the doors open.

FIGS. 1 and 2 illustrate a side-by-side refrigerator 100 including a fresh food compartment 102 and freezer compartment 104. Freezer compartment 104 and fresh food compartment 102 are arranged in a bottom mount configuration where the freezer compartment 104 is below the fresh food compartment 102. The fresh food compartment is shown with French opening doors 134 and 135. However, a single door may be used. Door or drawer 132 closes freezer compartment 104.

The fresh food compartment 102 and freezer compartment 104 are contained within an outer case 106. Outer case 106 normally is formed by folding a sheet of a suitable material, such as pre-painted steel, into an inverted U-shape to form top and sidewalls 230, 232 of case 106. Mullion 114 is preferably formed of an extruded ABS material. Mullion 114 separates the fresh food compartment 102 and the freezer compartment 104.

Door 132 and doors 134, 135 close access openings to freezer and fresh food compartments 104, 102, respectively. Each door 134 and 135 is mounted by a top hinge 136 and a bottom hinge 137 to rotate about its outer vertically oriented edge between an open position, as shown in FIG. 2, and a closed position shown in FIG. 1 closing the associated storage compartment.

In accordance with known refrigerators, refrigerator 100 also includes a machinery compartment (not shown) that at least partially contains components for executing a known vapor compression cycle for cooling air in the compartments. The components include a compressor (not shown), a condenser (not shown), an expansion device (not shown), and an evaporator (not shown) connected in series and charged with a refrigerant. The evaporator is a type of heat exchanger that transfers heat from air passing over the evaporator to a refrigerant flowing through the evaporator, thereby causing the refrigerant to vaporize. The cooled air is used to refrigerate one or more fresh food or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator 100.

The secondary loop temperature control circuit or distributed temperature system of the present invention may be used for a variety of distributed temperature control applications where localized temperature control is desired. Including where more than one compartment or region is temperature controlled which may be zoned with valves or other mechanisms. Additional applications for cooling may include: a surface, an ice-maker, a fast chill compartment, a chiller for through the door drink supply including water, soda or beer (keg-orator), dehumidifier cooling cycle or a vegetable drawer in the fresh food compartment of a refrigerator. Applications for heating include a defrost cycle for various components, a compartment for thawing food, a hot water dispenser or a compartment dehumidifier heating cycle. The distributed temperature system could supply zone specific temperature control such as for the door of the fresh food compartment or be utilized as the mechanism for maintaining the temperature for the entire compartment. Further, the system could be used to provide express cooling, freezing or heating, thawing areas where conduction of heat is utilized instead of heat convection. While the secondary loop temperature control circuit of the present invention may be used for any distributed temperature control needs, it will be described with respect to a temperature controlled compartment 200 mounted in the fresh food compartment 102 on the door 134 of a bottom mount refrigerator 100.

Figure 3:
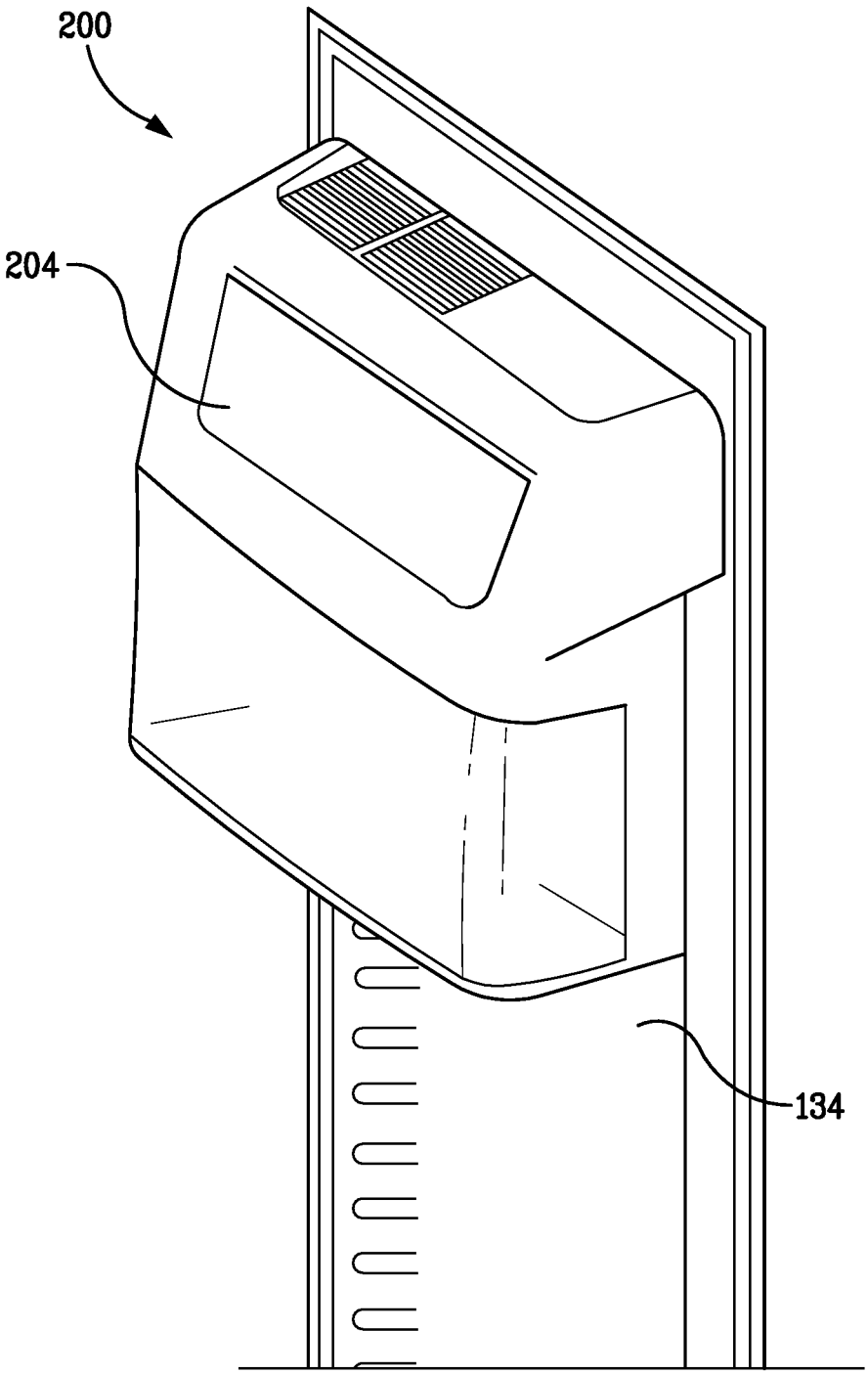
FIG. 3 is a perspective view of an exemplary compartment according to an aspect of the invention.

FIG. 3 is an exemplary embodiment of a compartment 200 mounted to the door 134 of a fresh food compartment. Temperature controlled compartment 200 has a door 204 moveable between an open position and a closed position allowing access to items stored therein.

Figure 4:
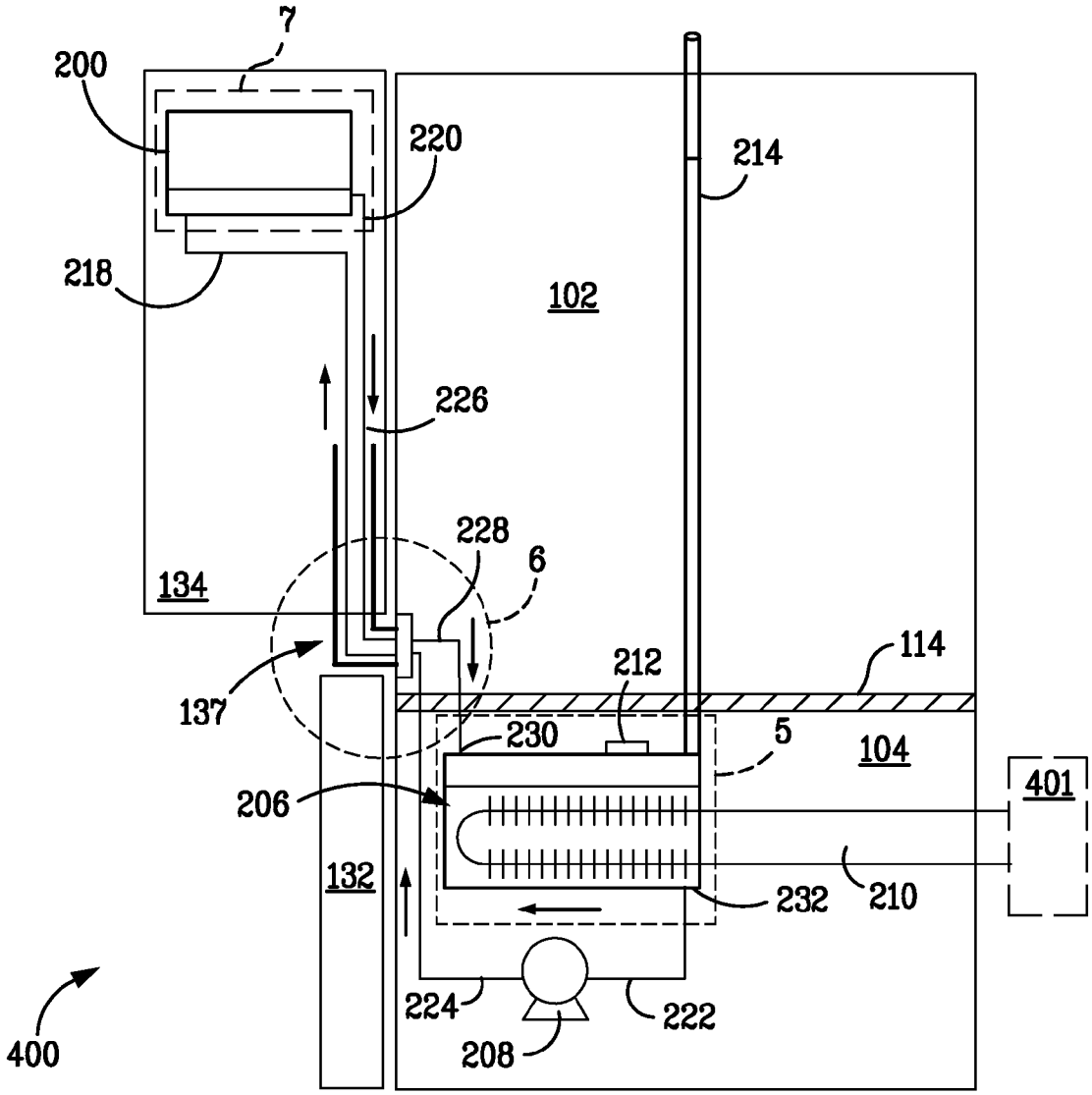
FIG. 4 is a schematic representation of an exemplary embodiment of the secondary loop cooling system according to an aspect of the invention.

FIG. 4 is an exemplary embodiment of the secondary loop temperature control circuit of the invention configured to cool a temperature controlled compartment 200. The secondary loop temperature control circuit is identified at 400 and represented schematically in FIG. 4. Temperature controlled compartment 200 is attached to the inside of door 134. However, Temperature controlled compartment may have individual access from outside the refrigerator, as a separate compartment of the refrigerator. Because temperature controlled compartment 200 is in fresh food compartment 102, a secondary loop temperature control circuit is used to reduce the temperature of the temperature-controlled compartment 200 below the temperature of the fresh food compartment, which is normally kept above a predetermined temperature which is typically the freezing point of water. However, temperature controlled compartment may also maintain a temperature above the temperature in the fresh food compartment of the refrigerator 100.

The secondary loop temperature control circuit of FIG. 4 maintains a reservoir 206 in freezer compartment 104. The reservoir 206 includes a volume of a temperature control medium, herein after referred to as "medium". In the present embodiment the medium is filled with a propylene glycol and water mixture. The medium is supplied externally through port 212. The reservoir 206 is in thermal communication with freezer compartment 104 thereby maintaining the temperature of the propylene glycol mixture at the temperature of the freezer compartment 104. However, the medium in reservoir 206 may be further cooled by a sealed circuit 210 connected to the evaporative cooling system of the refrigerator or other cooling means. The evaporative cooling system is identified in FIG. 4 as 401.

Figure 5:
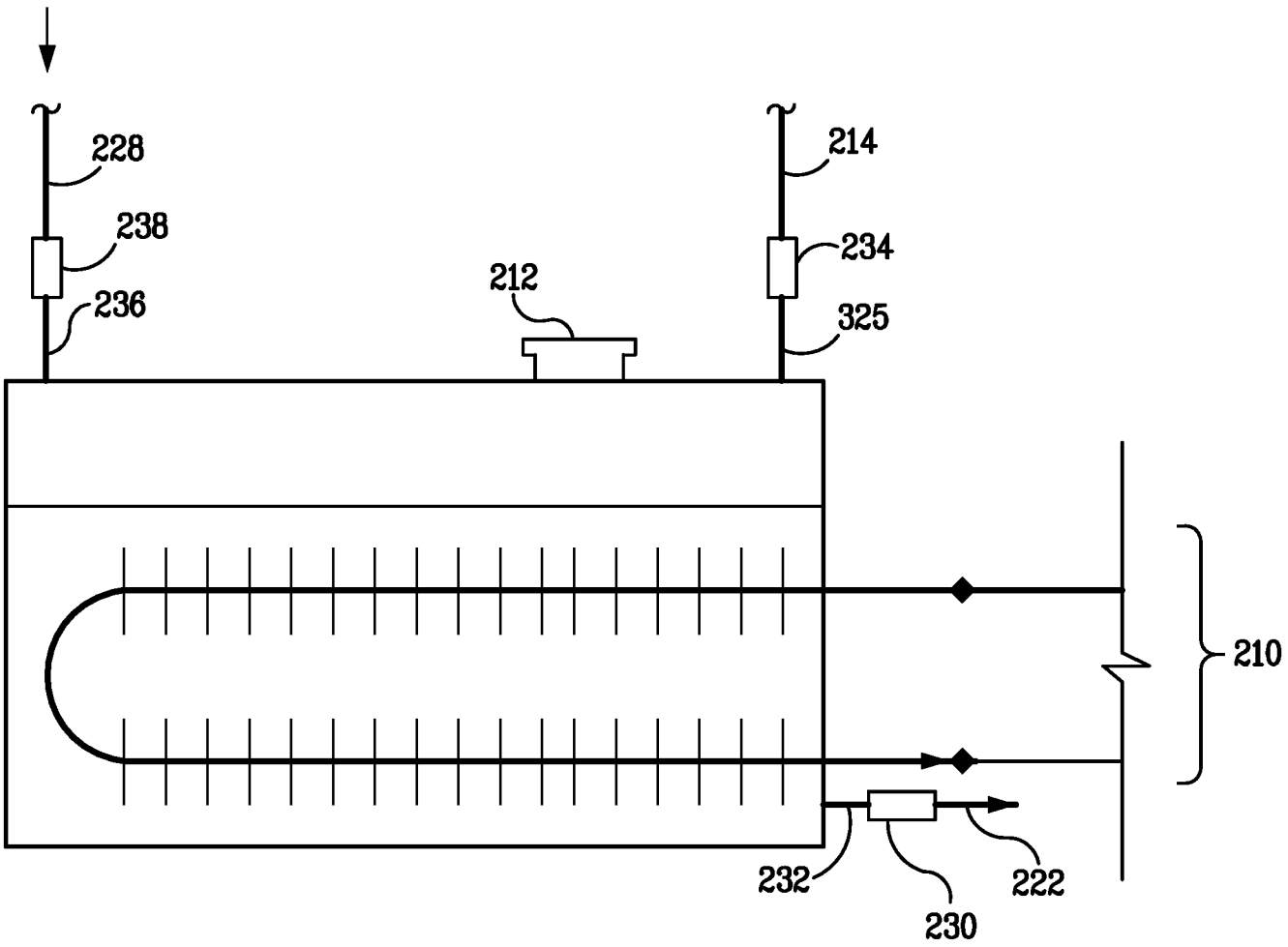
FIG. 5 is a diagram of the heat exchanger of the secondary loop cooling system of FIG. 4.

The reservoir 206 has a port 212 to ensure proper levels of medium are maintained in the system. As shown in FIG. 5, reservoir 206 has a vent tube 214 to prevent pressurizing the system during expansion of the propylene glycol mixture. Vent tube 214 is removeably connected to reservoir 206 by a conventional, well known connector 234. Reservoir 206 is located in freezer compartment 104 to reduce the temperature of the medium. In this configuration reservoir 206 acts as a heat exchanger. However, the reservoir 206 may also be located adjacent to the freezer compartment and be provided with a heat exchanger for thermal communication with the freezer compartment 104. Where additional cooling is required a cooling circuit 210 may be used. In this configuration the reservoir may be located anywhere within or proximate to the refrigerator 100. The cooling circuit 210 may be an additional circuit of an evaporative cooling system of the refrigerator, a thermal electric heat exchanger or another means for removing heat from the medium. However, the circuit 210 could be a condensing circuit of the evaporative system of the refrigerator or could otherwise provide heat to the medium for applications requiring temperatures above the predetermined temperature of compartment of the refrigerator.

Figure 7:
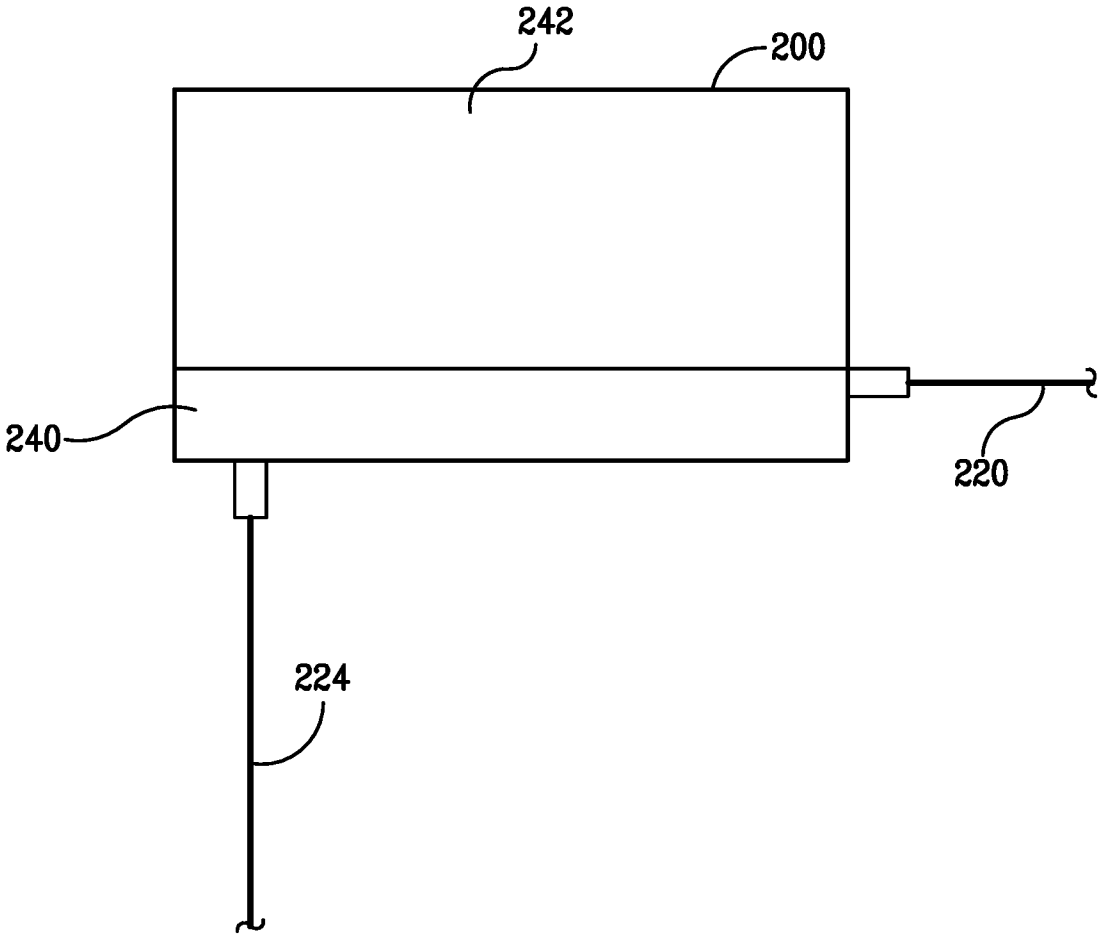
FIG. 7 is a diagram of the cooled surface of the secondary loop cooling system of FIG. 4.

Medium is circulated from the reservoir 206 through a series of conduits or tubing 222, 224, 218 to a temperature controlled compartment 200. A pump 208 or other circulating means is used to circulate the medium. Pump 208 circulates the propylene glycol mixture from tubing 222 to tubing 224 then through mullion 114 and hinge 138 (see FIG. 2) to the temperature controlled compartment 200. Pump 208 may be any suitable pump for moving a fluid in a circuit including a reversible or variable speed pump. The medium circulates through a heat exchanger 240 (shown in FIG. 7). The medium is then circulated back to reservoir 206 in tubes 220, 226, 228.

FIG. 5 shows an exemplary embodiment of the reservoir 206. The medium exits the reservoir 206 in tubing 222 at interface 232. Tubing 222 is removeably connected to reservoir 206 by conventional connector 230. The propylene glycol mixture returns to the reservoir 206 at 236 through tubing 228. Tubing 228 is removeably connected to the reservoir 206 by connector 238. Vent 214 is removeably attached to reservoir 206 at 235 through connector 234. Interfaces 232, 235 and 236 may be brazed for use with copper tubing or tapped and threaded for use with an instant fitting. Connectors 230, 234 and 238 may be any pipe or tubing connector.

Figure 6:
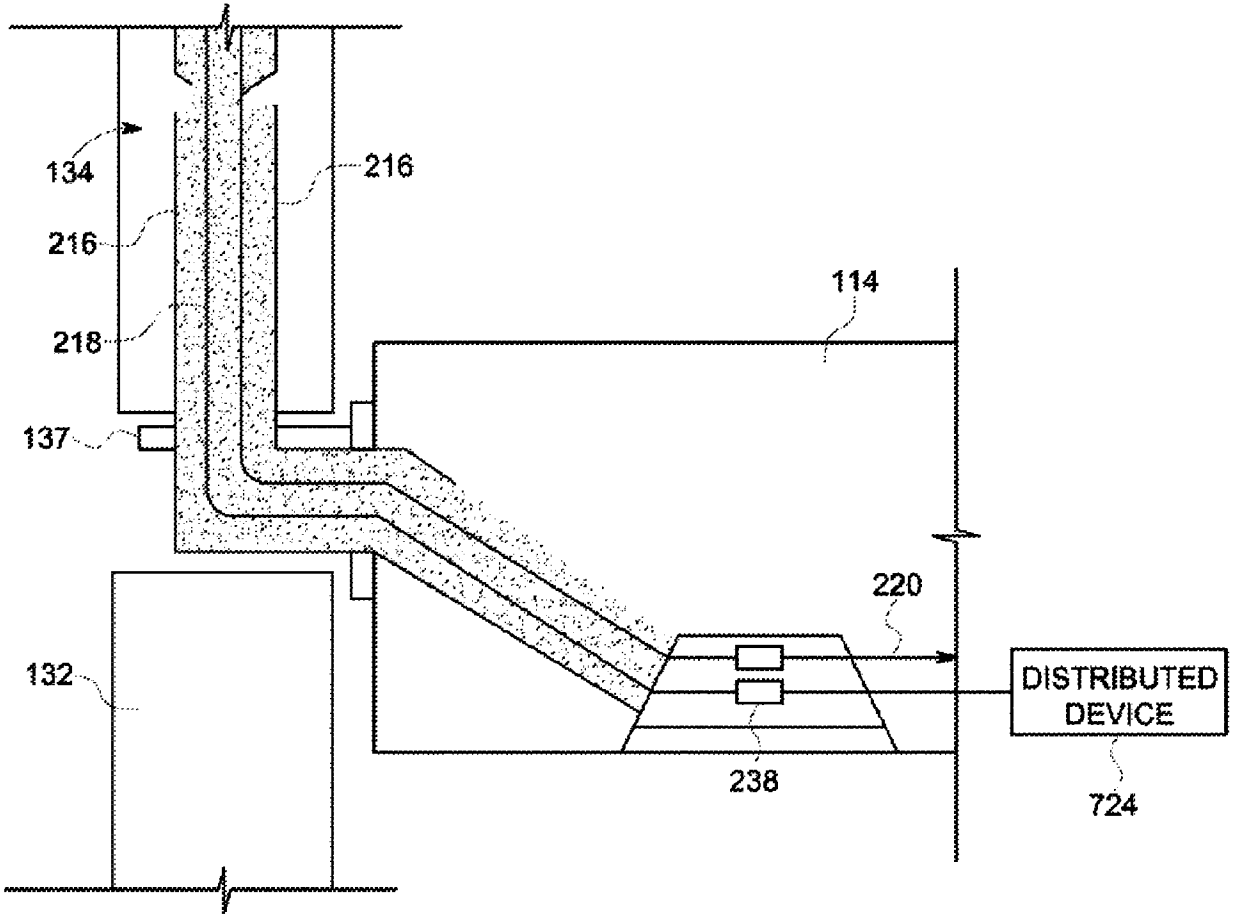
FIG. 6 is a diagram of the hinge and channel of the secondary loop cooling system of FIG. 4.

As shown in FIG. 6, tubing 224 may include additional connectors 238 to facilitate exchange of parts or even a distribution system to supply the propylene glycol mixture to other components where more than one distributed device 724 is used. Tube 224 passes hinge 137 and includes a central channel for housing tubing 220, 224. Central channel protects tubing 220, 224 while in hinge 137 after exiting mullion 114 and entering door 134. A heating element 216 may be incorporated into the central channel to prevent frost buildup that may interfere with the operation of hinge 137. Tubing 220 enters the central channel from the door of the fresh food compartment and exits into mullion 114 to return to the reservoir 206.

Tubing 224 supplies medium to the temperature-controlled compartment 200. The medium flows through a system of tubes in heat exchanger 240 of temperature controlled compartment 200. Where the medium is chilled this can reduce the temperature of the air or any object in the cavity 242 of temperature controlled compartment 200. Where the medium is heated this can increase the temperature of the temperature-controlled compartment 200. After leaving the heat exchanger 240 the medium returns to the reservoir 206 through tubes 220 and 228.

Figure 8:
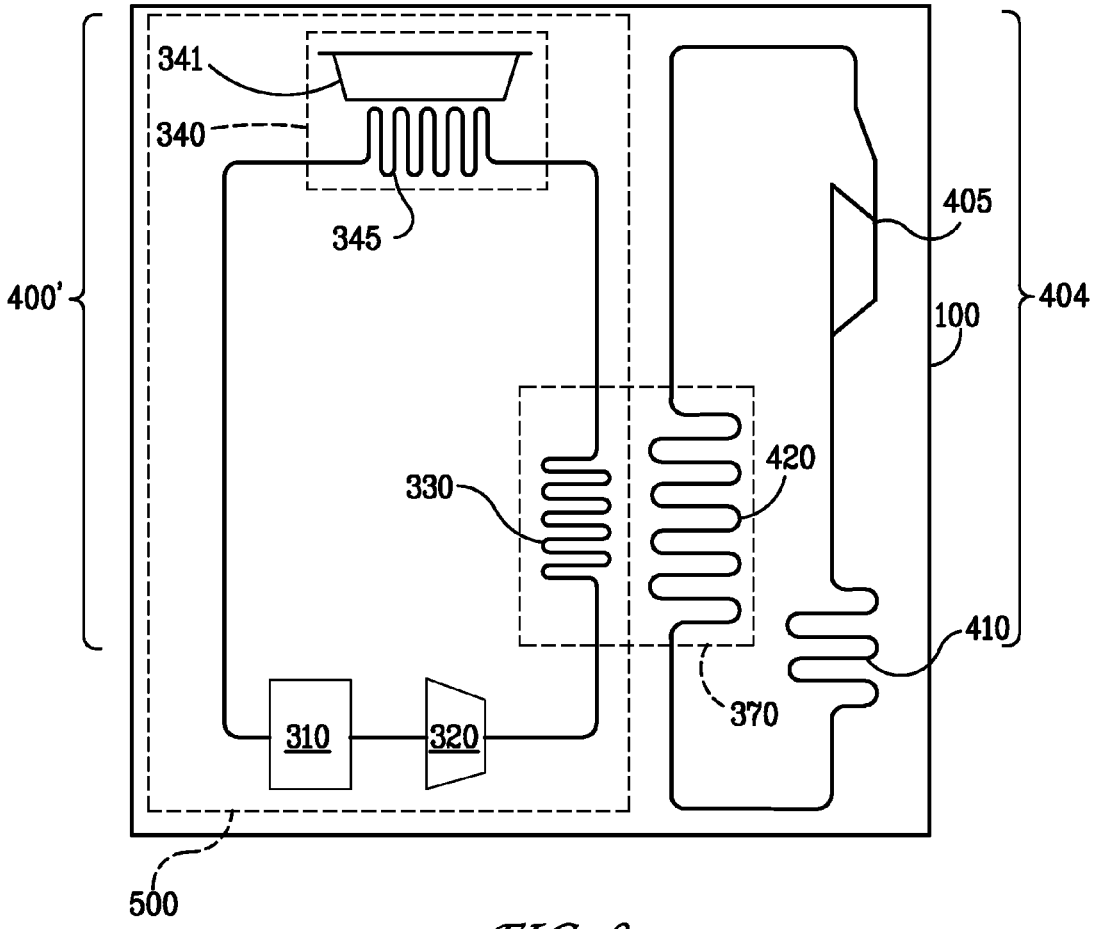
FIG. 8 is a schematic of an alternate embodiment for an icemaker according to the invention.

In another exemplary embodiment of FIG. 8 the secondary loop temperature control system 400' is housed in the fresh food compartment 500 of refrigerator 100 and includes a thawing compartment 340. Propylene glycol is circulated from a heat exchanger 330 in closed transfer compartment 370 to the thawing compartment 340. Expansion tank 310 permits expansion and contraction of the propylene glycol. Closed transfer compartment 370 may contain propylene glycol or other fluid to transfer heat from condenser 420 to heat exchanger 330. Condenser 420 may be a condenser in an evaporative system 404, which includes pump 405 and evaporator 410. Heated propylene glycol is moved to thawing compartment 340 by pump 320. The heat is transferred to the shelf, pan or chamber 341 of the thawing compartment by conduction from heat exchanger 345.

While the invention has been described in terms of various specific embodiments, those skilled in the art will recognize that the invention can be practiced with modification within the spirit and scope of the claims.

The invention claimed is:

1. A refrigerator comprising:

a fresh food compartment;

a freezer compartment;

a secondary temperature controlled compartment;

a primary temperature control loop configured to provide cooling of the fresh food and freezer compartments; and a secondary temperature control loop for regulating a temperature of the secondary temperature controlled compartment, the secondary temperature control loop comprising:

a reservoir configured to store a temperature control medium;

a first heat exchanger in thermal communication with the primary temperature control loop and the temperature control medium, the first heat exchanger being configured to heat or cool the temperature control medium; and a second heat exchanger in thermal communication with the secondary temperature controlled compartment and the temperature control medium, the second heat exchanger being configured to have the temperature control medium flow therethrough for regulating a temperature of the secondary temperature controlled compartment.

2. The refrigerator of claim 1, further comprising an evaporator circuit and a condenser circuit in the primary temperature control loop, the first heat exchanger being in thermal communication with one of the evaporator circuit or the condenser circuit.

3. The refrigerator of claim 1, further comprising a door for the fresh food compartment, wherein the temperature controlled compartment is mounted on an exterior portion of the door of the fresh food compartment.

4. The refrigerator of claim 3, wherein the refrigerator is a bottom mount freezer refrigerator and the fresh food compartment is disposed above the freezer compartment.

5. The refrigerator of claim 3, further comprising a hinge coupling the door of the fresh food compartment to the refrigerator, a central channel within the hinge, tubing coupling the first heat exchanger with the second heat exchanger, the tubing passing through the central channel and through an interior of the fresh food compartment door to the secondary temperature controlled compartment.

6. The refrigerator of claim 5, further comprising a heating element in the central channel.

7. The refrigerator of claim 1, further comprising a vent tube removably coupled to the first heat exchanger.

8. The refrigerator of claim 1, further comprising a sealed temperature control circuit coupled to the first heat exchanger of the secondary temperature control loop, the sealed temperature control circuit being configured to have the temperature control medium flow therethrough.

9. The refrigerator of claim 8, wherein the sealed temperature control circuit is thermally coupled to the primary temperature control loop.

10. The refrigerator of claim 9, further comprising an evaporative cooling system for controlling the primary temperature control loop and wherein the sealed temperature control circuit is thermally coupled to the evaporative cooling system.

11. The refrigerator of claim 1, wherein the secondary temperature controlled compartment is a heating or cooling compartment.

12. The refrigerator of claim 1, wherein the temperature control medium is propylene glycol.

13. The refrigerator of claim 1, further comprising tubing coupling the first heat exchanger with the second heat exchanger, a connector coupled to the tubing, and another temperature controlled compartment connected to the secondary temperature control loop via the connector.

14. The refrigerator of claim 1, further comprising an expansion tank downstream of the first heat exchanger and between the first heat exchanger and the second heat exchanger, a condenser circuit in the primary temperature control loop, the first heat exchanger being in thermal communication with the condenser circuit.

15. The refrigerator of claim 1, wherein the secondary temperature controlled compartment comprises a drawer or shelf.

16. The refrigerator of claim 1, wherein the secondary temperature controlled compartment is an icemaker or ice storage compartment.

17. The refrigerator of claim 1, further comprising a pump configured to flow the temperature control medium through the first heat exchanger and the second heat exchanger.

18. The refrigerator of claim 1, wherein the first heat exchanger is in thermal communication with a volume of air external to the refrigerator.

19. The refrigerator of claim 1, further comprising a connector to removably couple the secondary temperature controlled compartment to the secondary temperature control loop.

20. The refrigerator of claim 19, wherein the connector is configured to enable connection of a plurality of secondary temperature controlled compartments to the secondary temperature control loop.

* * * * *